US009912089B2

(12) United States Patent
Akiguchi et al.

(10) Patent No.: US 9,912,089 B2
(45) Date of Patent: Mar. 6, 2018

(54) ELECTRICAL CONNECTOR HAVING A FEMALE TERMINAL WITH A HOLDING PROTRUSION

(71) Applicants: Tyco Electronics Japan G.K., Kanagawa-ken (JP); Toyota Jidosha Kabushiki Kaisha, Aichi-ken (JP)

(72) Inventors: Tetsuro Akiguchi, Kanagawa-ken (JP); Kazuhiko Ueda, Aichi-ken (JP); Natsuki Nozawa, Aichi-ken (JP); Hitoshi Ozaki, Aichi-ken (JP); Masao Noguchi, Aichi-ken (JP); Arata Harada, Aichi-ken (JP)

(73) Assignees: Tyco Electronics Japan G.K., Kanagawa-Ken (JP); Toyota Jidosha Kabushiki Kaisha, Aichi-Ken (JP)

( * ) Notice: Subject to any disclaimer, the term of this patent is extended or adjusted under 35 U.S.C. 154(b) by 98 days.

(21) Appl. No.: 14/613,470

(22) Filed: Feb. 4, 2015

(65) Prior Publication Data

US 2015/0222039 A1 Aug. 6, 2015

(30) Foreign Application Priority Data

Feb. 4, 2014 (JP) ..... 2014-019323

(51) Int. Cl.

| | |
|---|---|
| ***H01R 13/41*** | (2006.01) |
| ***H01R 13/14*** | (2006.01) |
| *H01R 12/91* | (2011.01) |
| *H01R 13/502* | (2006.01) |

(52) U.S. Cl.

CPC ..... *H01R 13/14* (2013.01); *H01R 13/41* (2013.01); *H01R 12/91* (2013.01); *H01R 13/502* (2013.01)

(58) Field of Classification Search

CPC ..... H01R 13/14; H01R 13/41; H01R 12/91; H01R 13/502

USPC ..... 439/733.1, 751, 752.5, 872, 873, 512, 439/507, 660, 620.26, 510

See application file for complete search history.

(56) References Cited

U.S. PATENT DOCUMENTS 4,188,715 A 2/1980 Ammon et al.
4,220,393 A * 9/1980 Ammon ..... H01R 12/585 439/682

(Continued)

FOREIGN PATENT DOCUMENTS

EP 0407079 A1 9/1991
JP 5756464 Y2 12/1982

(Continued)

OTHER PUBLICATIONS

Japanese Office Action, dated Aug. 19, 2015, 4 pages.
Abstract of JP2009117058(A), dated May 28, 2009, 1 page.
Abstract of JP02106882(A), dated Apr. 18, 1990, 1 page.
Japanese Office Action, dated Jun. 3, 2015, 3 pages.
European Search Report, Application No. EP 15 15 3018, dated Jun. 26, 2015, 8 pages.

*Primary Examiner* — Edwin A. Leon
*Assistant Examiner* — Paul Baillargeon
(74) *Attorney, Agent, or Firm* — Barley Snyder

(57) ABSTRACT

An electrical connector is disclosed having a terminal housing, a female terminal, and a holding protrusion. The female terminal is positioned in the terminal housing and has a terminal body into which a complementary male terminal may be inserted and extracted. The holding protrusion projects from the terminal body in a direction orthogonal to inserting and extracting directions, and is press-fitted in the terminal receiving terminal housing.

13 Claims, 7 Drawing Sheets

(56) References Cited

U.S. PATENT DOCUMENTS

| | | | | |
|---|---|---|---|---|
| 5,199,886 | A * | 4/1993 | Patterson | H01R 12/727 439/686 |
| 5,498,169 | A | 3/1996 | Ikemoto | |
| 5,641,314 | A * | 6/1997 | Broschard, III | H01R 13/428 439/733.1 |
| 5,997,315 | A | 12/1999 | Akama et al. | |
| 6,109,981 | A | 8/2000 | Jin-ichl et al. | |
| 6,851,986 | B2 * | 2/2005 | Zhao | H01R 13/2435 439/595 |
| 8,246,391 | B1 * | 8/2012 | Qu | H01R 13/428 439/733.1 |
| 2007/0010125 | A1 | 1/2007 | Regnier | |
| 2011/0143559 | A1 | 6/2011 | Furukawa et al. | |

FOREIGN PATENT DOCUMENTS

| | | | |
|---|---|---|---|
| JP | 02106882 | A | 4/1990 |
| JP | 71572 | U | 1/1995 |
| JP | 0719102 | U | 5/1995 |
| JP | 2009117058 | A | 5/2009 |
| JP | 4414845 | B2 | 11/2009 |
| JP | 2011129512 | A | 6/2011 |
| JP | 2012-505511 | A | 3/2012 |
| JP | 2012505511 | A | 3/2012 |
| WO | 8603626 | A1 | 6/1986 |

* cited by examiner (a)

(b)

ELECTRICAL CONNECTOR HAVING A FEMALE TERMINAL WITH A HOLDING PROTRUSION

CROSS-REFERENCE TO RELATED APPLICATION

This application claims priority under 35 U.S.C. § 119 (a)-(d) to Japanese Patent Application No. 2014-019323, dated Feb. 4, 2014.

FIELD OF THE INVENTION

The invention is generally related to an electrical connector, and more specifically, to an electrical connector having a female terminal with a holding protrusion.

BACKGROUND

Conventionally, many electrical connectors have female terminals. Generally, the female terminals have a form of a socket into/from which a male terminal is inserted/extracted. The female terminals are often assembled into a housing.

In Japanese Patent Application No. 2012-505511 A, female terminals are assembled in a housing, and secured therein through deflecting engaging beams formed in the housings. The female terminals are held in the housing through an elastic force exerted by the engaging beams, commonly called lances. In other examples, the engaging beams might be formed on the female terminals and directly engage a housing.

Electrical connectors are used in a wide variety of environments, and depending on the application, the connectors can be subjected to strong vibrational forces. In addition to vibrational forces, large external forces might directly act on the female terminals upon insertion and extraction or the like. Therefore, it is necessary to provide a securing force sufficient to hold the female terminals in the housing, such that the female terminals do not disengage from the engaging beams of the housing in such instances.

While increasing the thickness or the length of the engaging beams might be helpful for this purpose, the space necessary for the engaging beams to deflect would be increased which, in turn, would lead to increases in size of the connector.

Therefore, there is a need for an electrical connector capable of generating a sufficient holding force on the female terminals, while avoiding subsequent increases in size.

SUMMARY

An electrical connector has a terminal housing, a female terminal, and a holding protrusion. The female terminal is positioned in the terminal housing and has a terminal body, into which a complementary male terminal may be inserted and extracted. The holding protrusion projects from the terminal body in a direction orthogonal to inserting and extracting directions, and is press-fitted in the terminal receiving terminal housing.

BRIEF DESCRIPTION OF THE DRAWINGS

The invention will now be described by way of example, with reference to the accompanying Figures, of which.

DETAILED DESCRIPTION OF THE EMBODIMENT(S)

The present invention will now be described in details based on the electrical connector 1 shown in the attached drawings FIG. 1 to FIG. 7.

Figure 1:
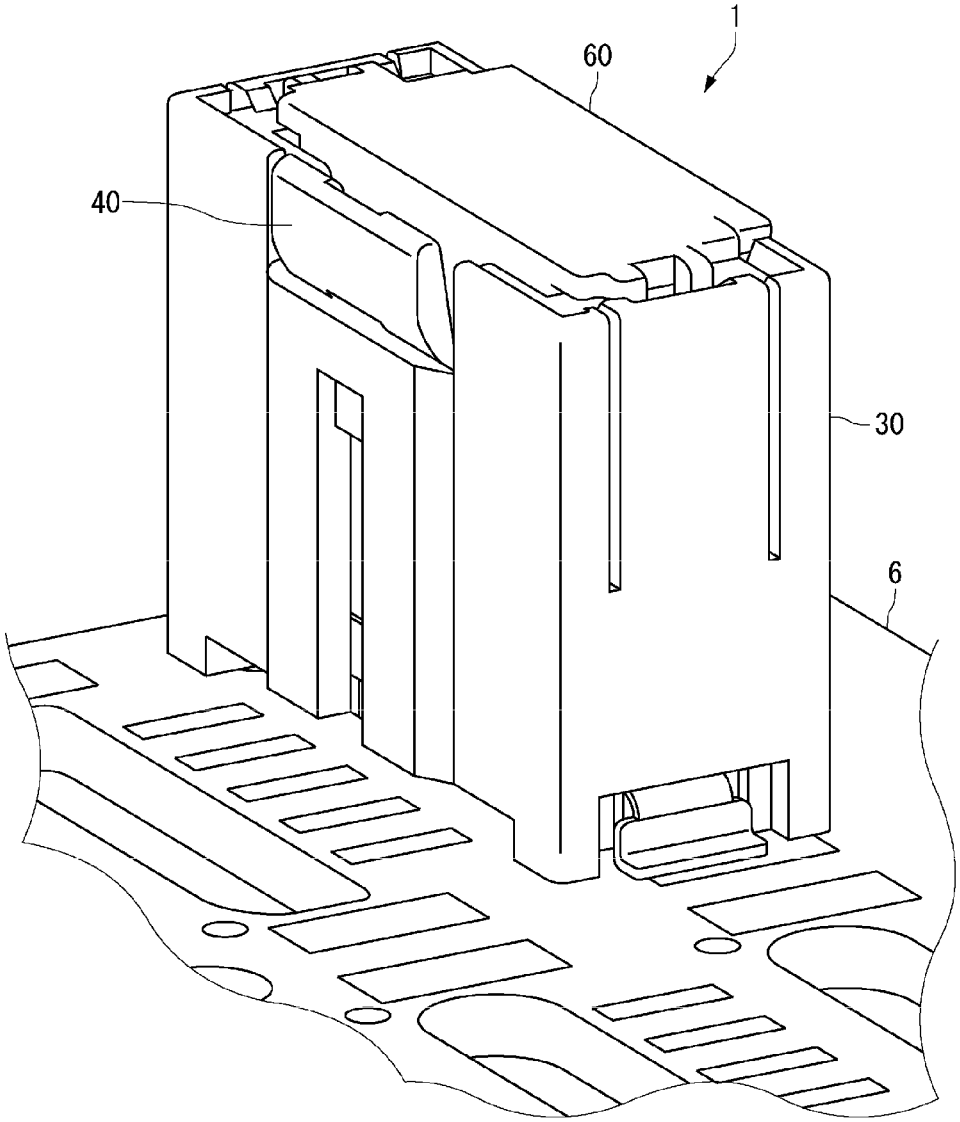
FIG. 1 is a perspective view of the electrical connector.
Figure 2:
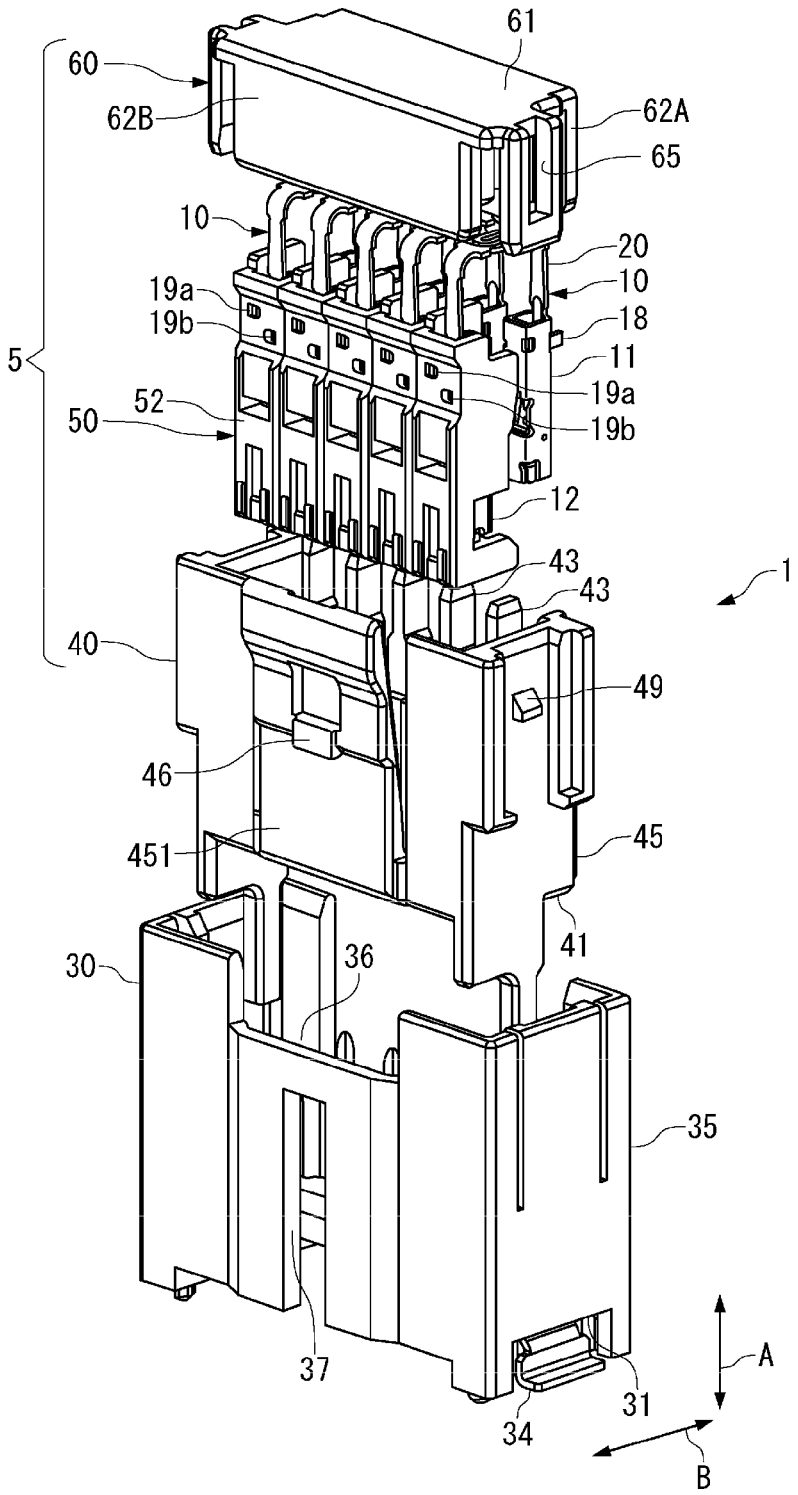
FIG. 2 is an exploded perspective view of the electrical connector of FIG. 1.
Figure 3:
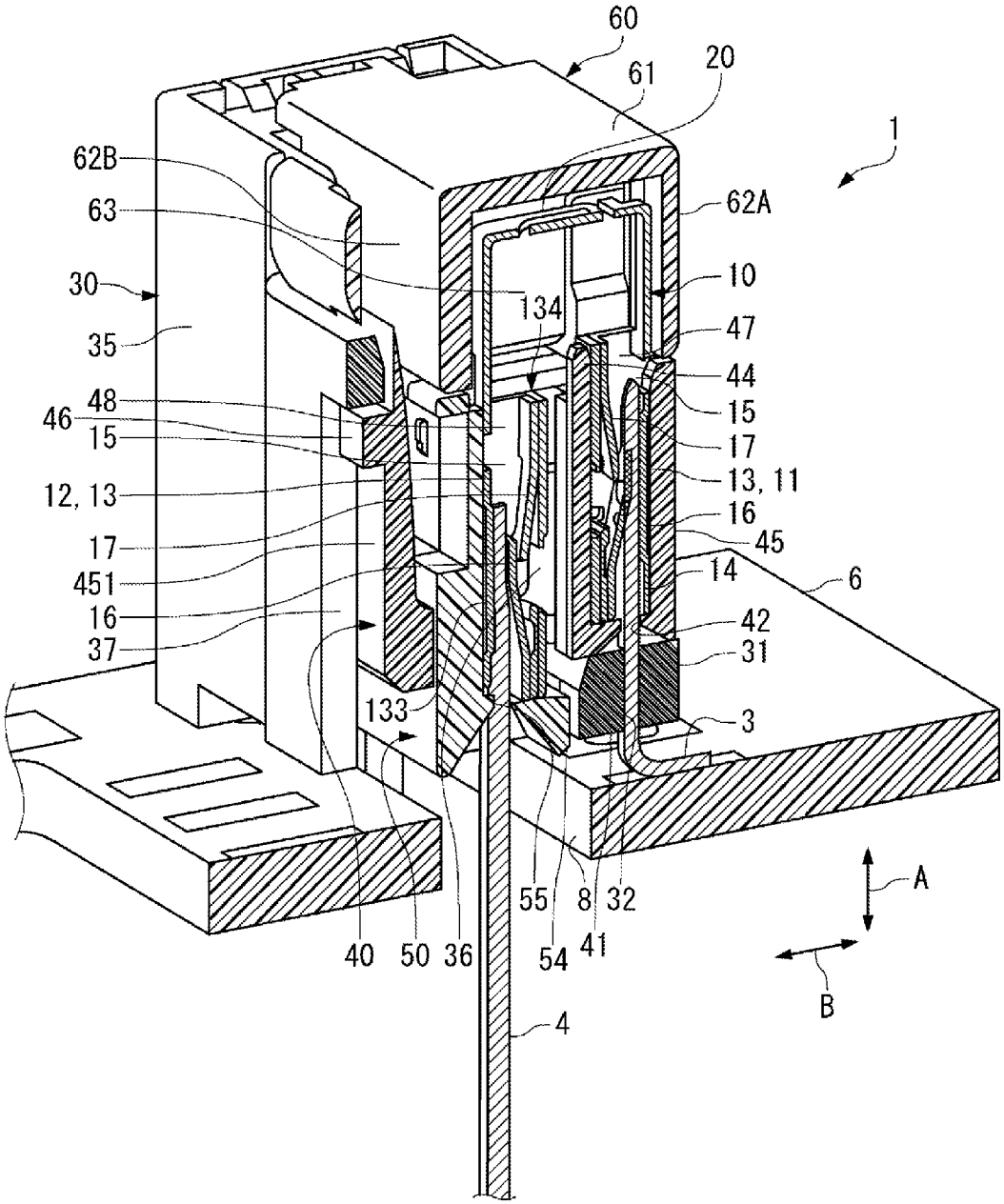
FIG. 3 is a longitudinal sectional view of the electrical connector of FIG. 1.

In the embodiments of FIGS. 2 and 3, the electrical connector 1 has a plurality of female type terminals 10, a terminal housing 5 into which the female type terminals 10 are positioned, and a shell 30 for holding a first male type terminal 3. To each of the female type terminals 10, a first male type terminal 3 and a second male type terminal 4 may be electrically connected, and the terminal housing 5 is connected to the shell 30. A pair of male terminals, defined by one first male type terminal 3 and one second male type terminal 4, is allotted to each of the female type terminals 10. The first male type terminals 3 are connected and fixed to a circuit board 6 while the second male type terminals 4 are connected and fixed to an electronic device (not shown) disposed downward of the circuit board 6 in the drawing. The electronic device is a device different from the electronic device comprising the circuit board 6. In this manner, since the first male type terminal 3 and the second male type terminal 4 are respectively fixed to different devices, each terminal 3, 4 may exhibit modes of vibration differing from the other.

The female type terminal 10 is employed for absorbing the different modes of vibration. In an embodiment of FIG. 4, the female type terminal 10 has a first female terminal 11, a second female terminal 12 and a coupling spring 20 connecting the first female terminal 11 and the second female terminal 12. The first female terminal 11 and the second female terminal 12 are positioned in parallel, and the first male type terminal 3 and the second male type terminal 4 are respectively inserted into the female terminals 11, 12 from the same direction.

In the female type terminal 10, the first female terminal 11, the second female terminal 12 and the coupling spring 20 are integrally formed by stamping a metallic plate of high conductivity such as copper or copper alloy and by performing bending thereof.

While the first female terminal 11 and the second female terminal 12 are manufactured to be of the same specification, positions at which they are connected to the first male type terminal 3 and the second male type terminal 4 differ in the inserting and extracting directions A (See FIGS. 2 and 3). The first female terminal 11 and the second female terminal 12 can displace independently with respect to each other upon being subject to different vibrational forces.

In an embodiment, the female type terminal 10 is secured to a second terminal housing 50, having holding protrusions 19*a*, 19*b* disposed on the second female terminal 12 and being press-fitted into locking tab receiving spaces 53, 53 of the second terminal housing 50.

Figure 4:
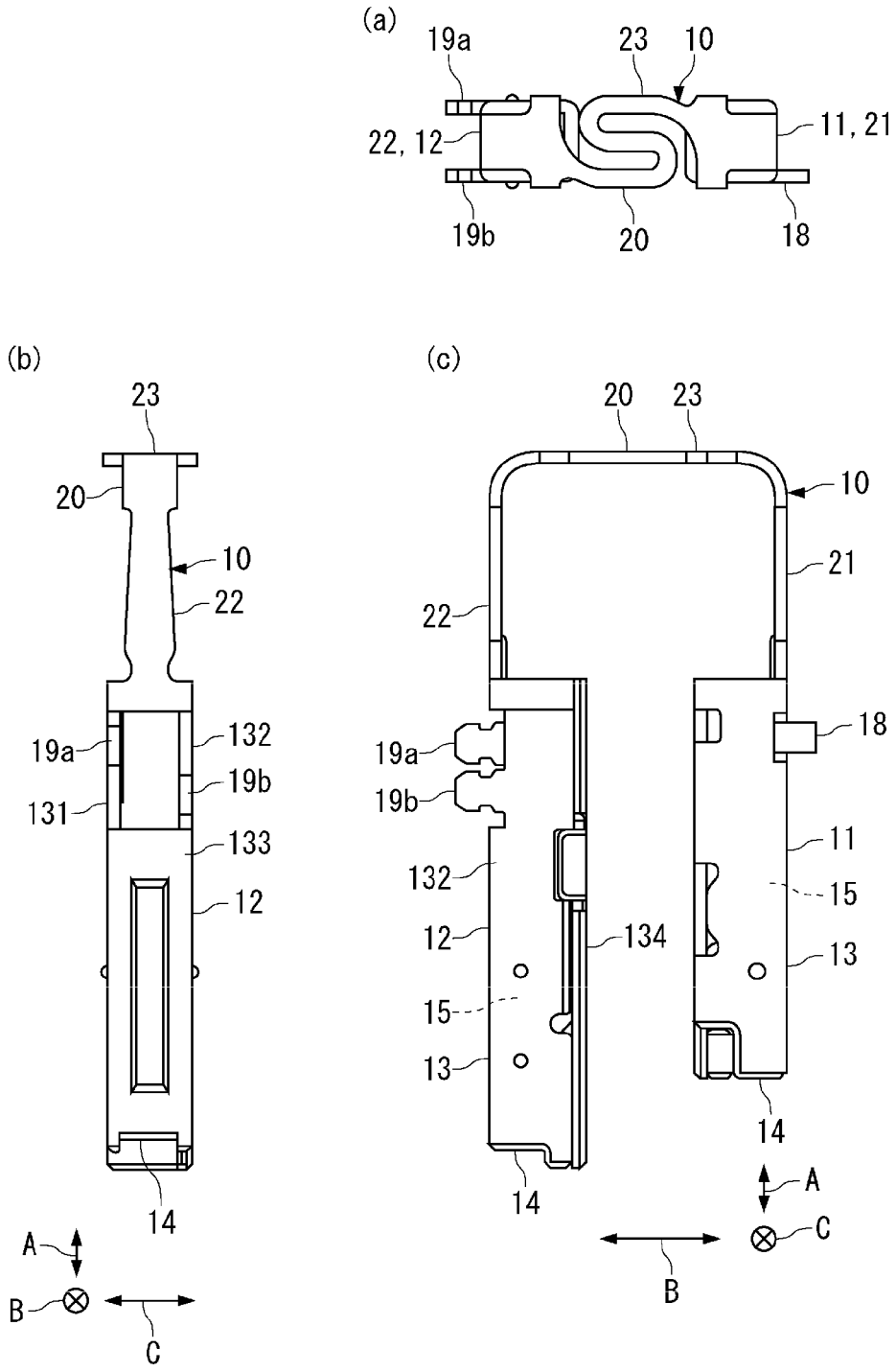
FIGS. 4(*a*)-(*c*) are schematic views of three faces of a female type terminal of the electrical connector of FIG. 1.

In the embodiments of FIGS. 3 and 4, the second female terminal 12 includes a terminal body 13 with a male terminal receiving opening 14, into which the second male type terminal 4 is inserted, being open at mating end thereof, and a male terminal receiving space 15 for receiving the second male type terminal 4 inserted through the male terminal receiving opening 14. The coupling spring 20 is integrally connected to an opposite connecting end of the terminal body 13 to the mating end.

The terminal body 13 has a generally tubular body with a rectangular cross-section. The terminal body 13 is formed by bending a metallic plate.

Figure 6:
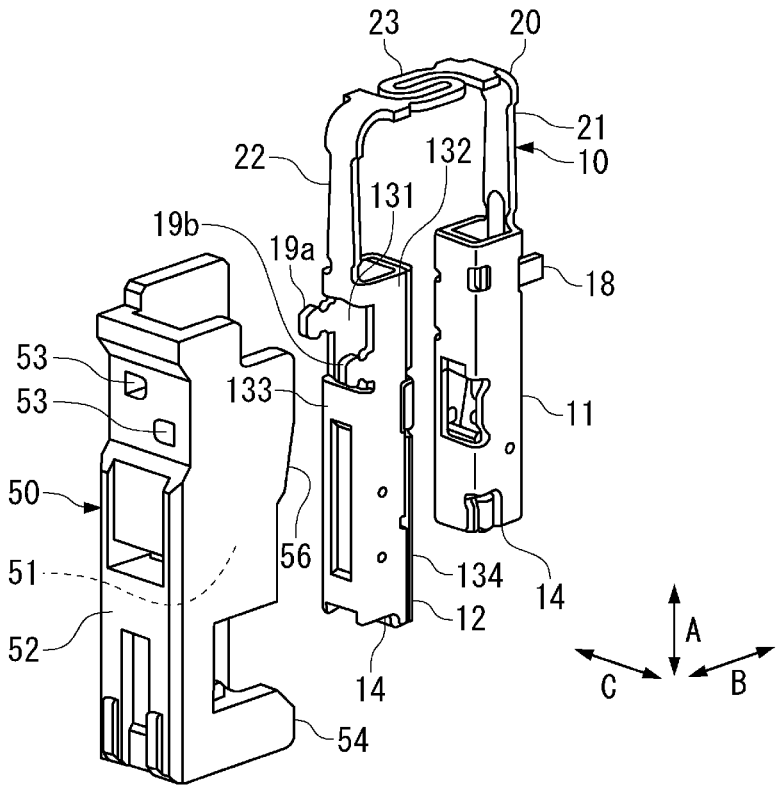
FIGS. 6(*a*) and (*b*) are perspective views of the female type terminal and a housing constituting the electrical connector of FIG. 1, wherein both members are separated in FIG. 6(*a*) and both members are assembled in FIG. 6(*b*).
Figure 6:
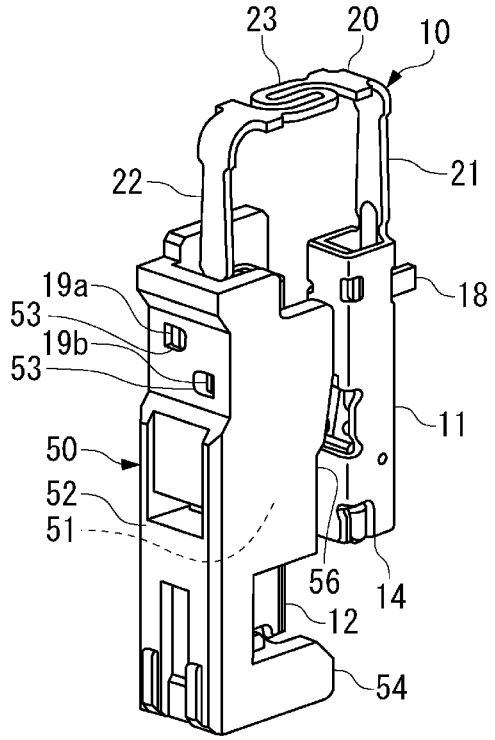

In an embodiment of FIG. 4(*c*), the terminal body 13 includes two holding protrusions 19*a*, 19*b* proximate to the connecting end, and projecting outward in a width direction B, orthogonal to the inserting and extracting directions A. The holding protrusions 19*a*, 19*b* are formed substantially tabular in shape, with a width being measured along the inserting and extracting directions A, and a thickness being measured substantially perpendicular to the width. The holding protrusions 19*a*, 19*b* are press-fitted into the locking tab receiving spaces 53, 53 of the second terminal housing 50 (FIG. 6).

The holding protrusions 19*a*, 19*b* respectively project outward from edges of a pair of side walls 131, 132 along the width direction B from among four side walls of the terminal body 13 in the width direction B, towards a side opposite to the first female terminal 11.

The holding protrusions 19*a*, 19*b* are formed by stamping regions corresponding to a side wall 133 orthogonal to the width direction B and by bending the periphery of the metallic plate forming the terminal body 13.

In the embodiments of FIGS. 4(*b*) and 4(*c*), the holding protrusions 19*a*, 19*b* are positioned in parallel, while leaving a space in a plate thickness direction, and their positions in the inserting and extracting directions A differ from each other. That is, the holding protrusions 19*a*, 19*b* are disposed in a staggered manner when viewed perpendicular to the inserting and extracting direction A. In an embodiment (not shown), the holding protrusions 19*a*, 19*b* are positioned in the same plane along the inserting and extracting directions A. In another embodiment, the holding protrusions are positioned a first distance apart along the inserting and extracting directions A. In another embodiment of FIG. 4, the holding protrusions 19*a*, 19*b* are positioned in different planes along the inserting and extracting directions. In another embodiment of FIG. 4, the holding protrusions 19*a*, 19*b* are positioned a second distance apart, in a direction perpendicular to the inserting and extracting directions A.

Figure 5:
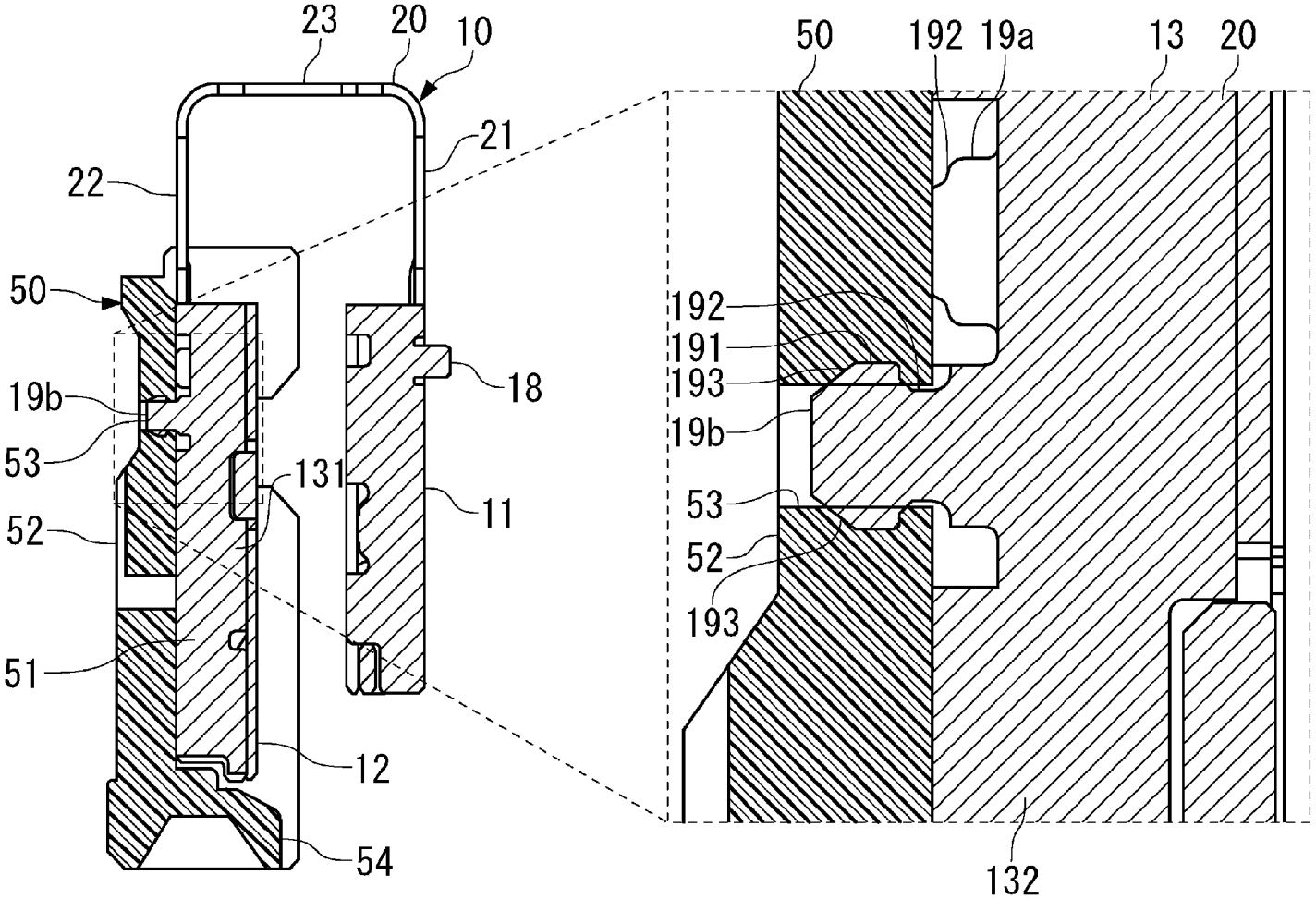
FIG. 5 is a sectional view of holding protrusions of the female terminal.

In an embodiment of FIG. 5, the holding protrusion 19*b* includes a locking tab 191 which is press-fitted into a locking tab receiving space 53 of the second terminal housing 50 and a connecting portion 192 extending continuously from the locking tab 191 to the side wall 132 of the terminal body 13. The same applies to the holding protrusion 19*a*.

The locking tab 191 has a lateral width (dimension in the inserting and extracting directions A) which is larger than an internal dimension of a locking tab receiving space 53 so that it is press-fitted by being pressed into the locking tab receiving space 53.

The locking tab 191 is formed with beveled edges 193 on both sides thereof such that a width along the inserting and extracting direction A becomes gradually narrower on a tip end. Since the locking tab 191 has a tapered shape due to the beveled edges 193, it is easy to insert the locking tab 191 into the locking tab receiving space 53.

A part of the connecting portion 192 has a lateral width along the inserting and extracting direction A which is narrower than that of the locking tab 191.

In addition to the holding protrusions 19*a*, 19*b*, on a side wall of the terminal body 13, as shown in an embodiment of FIG. 3, a primary contact 16 contacts the second male type terminal 4 inserted into the male terminal receiving space 15 and a supporting contact 17 supports the primary contact 16. Both the primary contact 16 and the supporting contact 17 are formed by cutting and raising the metallic plate.

The primary contact 16 and the supporting contact 17 extend inward from the side wall 134 opposing the side wall 133 (side wall on the second female terminal 12 side), towards the interior of the male terminal receiving space 15 and press an inserted second male type terminal 4 against the side wall 133.

Since the first female terminal 11 is configured to be substantially identical to the second female terminal 12, components which are substantially identical to those of the second female terminal 12 are marked with the same reference numerals.

As discussed above for the first female terminal 11 and the second female terminal 12, positions (points of contact) at which the terminals 11,12 are respectively connected to the first male type terminal 3 and the second male type terminal 4, differ in the inserting and extracting directions A. When the female type terminal 10 is connected to the terminal housing 5, the point of contact of the second female terminal 12 and the second male type terminal 4 is closer to the circuit board 6 than the point of contact of the first female terminal 11 and the first male type terminal 3, as shown in FIG. 3.

In an embodiment of FIG. 4(*c*), a positioning protrusion 18 for holding the female type terminal 10 between a first terminal housing 40 and an upper housing 60 is formed on the terminal body 13 of the first female terminal 11. In contrast, the above-described holding protrusions 19*a*, 19*b* are absent from the terminal body 13 of the first female terminal 11.

The positioning protrusion 18 is interposed between ribs 43 (FIG. 2) aligned in a comb-teeth shape on the first terminal housing 40, and is also interposed between an upper end of a side wall 45 of the first terminal housing 40 and a lower end of a side wall 62A of the upper housing 60. The female type terminal 10 is engaged and held by the terminal housing 5 on the first female terminal 11 side by the positioning protrusion 18.

The coupling spring 20 connecting the first female terminal 11 and the second female terminal 12 includes a pair of first and second connecting arms 21, 22 and a connecting beam 23 extending substantially perpendicular to the connecting arms 21,22, and connecting complimentary ends of the connecting arms 21, 22. The coupling spring 20 is formed to elastically deform at a force which is weaker than the force with which the first male type terminal 3 and the second male type terminal 4 are inserted and extracted with respect to the first female terminal 11 and the second female terminal 12. In other words, a pressure of contact (contact pressure) between the first male type terminal 3 and the second male type terminal 4 and the first female terminal 11 and the second female terminal 12 is greater than the force required to inserted the male type terminals 3,4.

The first connecting arm 21 is integrally connected to the connecting end of the first female terminal 11, and extends along the inserting and extracting directions A. Similarly, the second connecting arm 22 is integrally connected to the connecting end of the second female terminal 12, and extends in the inserting and extracting directions A. The connecting arms 21, 22 are formed along the inserting and extracting directions A so that they deflect in the width direction B, orthogonal to the inserting and extracting directions A. The connecting arms 21, 22 narrow in width along a portion proximate to where the connecting arms 21,22 are connected to the first female terminal 11 and the second female terminal 12 (see FIG. 4(*b*)), such that the connecting arms 21,22 easily deflect upon receiving an applied vibrational force.

In an embodiment of FIG. 4(*a*), the connecting beam 23 has an approximate S-shape to reduce its spring constant. The connecting beam 23 thus easily deflects in the inserting and extracting directions A. The female type terminal 10 is independently connected to the terminal housing 5, the first female terminal 11 is independently engaged with the first terminal housing 40 and the upper housing 60. The connecting beam 23 can accordingly be defined as a cantilever having a fixed end connected to the first connecting arm 21, and a free end connected to the second connecting arm 22. Thus, a vibrational force on the electronic device, to which the second male type connector 4 is connected, is independently conducted to the second female terminal 12 which is in contact and conduct with the second male type terminal 4.

In an embodiment of FIG. 3, a tab-type first male type terminal 3 is mated with the first female terminal 11. Further, a tab-type second male type terminal 4 is mated with the second female terminal 12. Respective surfaces of the first male type terminal 3 and the second male type terminal 4 are plated for maintaining favorable electric connection with the first female terminal 11 and the second female terminal 12.

The first male type terminal 3, being for example, L-shaped, is connected to a front surface of the circuit board 6. The terminal 3 may connected, for example, through soldering (not shown) or other common terminal connection methods known to those of ordinary skill in the art. The second male type terminal 4 may be a linear pin-type terminal fixed to an electronic device. (not shown). The electronic device is not in a mechanically coupled relationship with the circuit board 6. Accordingly, assuming that the electronic device and the circuit board 6 vibrate individually, the vibrational effects of the first male type terminal 3 and the second male type terminal 4 differ from each other since the vibration behaviors of the electronic device and the circuit board 6 differ from each other.

The first male type terminal 3 is electrically connected to the first female terminal 11 when inserted into the male terminal receiving space 15 of the first female terminal 11. The first male type terminal 3, which is pressed by the primary contact 16 and the supporting contact 17, both contacts 16,17 being elastically deformed through insertion of the first male type terminal 3, is pressed against an inner wall of the terminal body 13. With this positioning, the electric connection between the first female terminal 11 and the first male type terminal 3 is maintained.

The second male type terminal 4 is similarly connected electrically to the second female terminal 12 when inserted into the male terminal receiving space 15 of the second female terminal 12. The second male type terminal 4 is also pressed by the primary contact 16 and the supporting contact 17, thus the electric connection thereof to the second female terminal 12 is maintained. The circuit board 6 is formed with a terminal receiving groove 8 which extends through the front face to an opposite rear face of the circuit board 6. The second male type terminal 4 is inserted into the male terminal receiving space 15 by passing through the terminal receiving groove 8. The terminal receiving groove 8 is formed to have a sufficiently large width with respect to the thickness of the second male type terminal 4.

To assist in reliably maintaining electrical connection between the first male type terminal 3 and the first female terminal 11, the first female terminal 11 and the first male type terminal 3 contact and conduct with each other in a stable manner at a predetermined position while using the electrical connector 1. However, when an applied force results in displacement from the predetermined positions, there is a risk that the pressure of contact is insufficient so that it is necessary to maintain the positional relationship of both members.

The same applies to the second male type terminal 4 and the second female terminal 12.

In the embodiment of FIG. 2, the terminal housing 5 receives the female type terminal 10 therein.

In the embodiments of FIGS. 2 and 3, the terminal housing 5 has three elements, namely the first terminal housing 40, the second terminal housing 50 and an upper housing 60. The housing elements 40,50,60 are respectively manufactured by injection molding insulating resin.

The shell 30 has an assembly receiving space (not labeled) that receives the other housing elements, namely the first terminal housing 40, the second terminal housings 50 and the upper housing 60.

The shell 30 includes a shell base 31 positioned proximate to the front surface of the circuit board 6, and side walls 35 rising from a peripheral edge of the shell base 31. Collectively, the shell base 31 and the side walls 35 form an assembly receiving space 36 therein.

A first terminal receiving passageway 32 into which the first male type terminal 3 is inserted is formed in the shell base 31. The first male type terminal 3 is held by the shell 30 within the first terminal receiving passageway 32.

The shell 30 includes a mounting foot 34 extending out of the interface of the shell base 31 and one sidewall 35 thereof for fixing to the front surface of the circuit board 6. By soldering the mounting foot 34 to the front surface of the circuit board 6, the shell 30 is fixed to the circuit board 6. In another embodiment, the mounting foot 34 is attached to the circuit board 6 using other common attachment mechanisms known to those of ordinary skill in the art.

In the embodiments of FIGS. 2 and 3, the first terminal housing 40 includes a first housing base 41, which opposes the shell base 31 when inserted into the assembly receiving space 36, side walls 45 extending from the periphery of the first housing base 41, and a first partitioning wall 44 for dividing a region surrounded by the first housing base 41 and the side walls 45 into a first terminal receiving space 47 and a second terminal receiving space 48.

The first housing base 41 is formed with a second terminal receiving space 42, through which the first male type terminal 3 is inserted. There is a clearance between an inner peripheral surface of the second terminal receiving space 42 and an outer peripheral surface of the first male type terminal 3.

A locking protrusion 46 is positioned on a latch arm 451, which is positioned on the sidewall 45 of the first terminal housing 40, and being on the sidewall 45 opposite to the side on with the first female terminals 11 are dispose. The locking protrusion 46 extends outward to engage with a corresponding locking groove 37 disposed on the shell 30. The plurality of ribs 43, each having a comb-teeth shape, interpose the positioning protrusions 18 of the first female terminals 11 between them.

The first female terminals 11 positioned in the first terminal receiving space 47. A plurality of the second terminal housings 50, each individually holding the second female terminals 12, comprised by each of the plurality of female type terminals 10 is accommodated in the second terminal receiving space 48.

In an embodiment of FIG. 2, the second terminal housings 50 individually hold the second female terminals 12.

Figure 7:
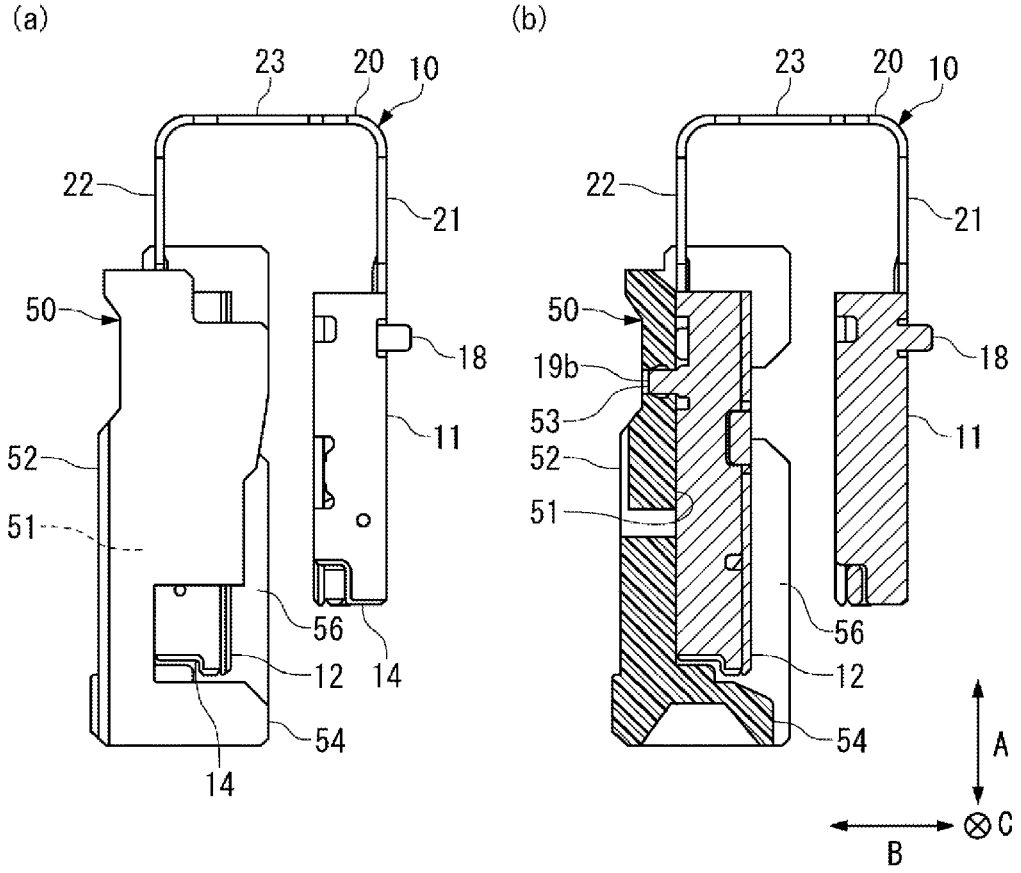
FIGS. 7(*a*) and (*b*) are views showing a state in which the female type terminal and the housing of FIG. 6 are assembled, wherein FIG. 7(*a*) is a front view and FIG. 7(*b*) is a longitudinal sectional view.

In an embodiment of FIG. 6, the second terminal housing 50 has a box-shaped body having a terminal receiving opening on one end side in the width direction B. The second female terminal 12 of the female type terminal 10 is received in a terminal receiving space 51 in the interior of the second terminal housing 50 through the terminal receiving opening (FIG. 6, FIG. 7).

Two locking tab receiving spaces 53, 53, into which the holding protrusions 19*a*, 19*b* of the second female terminal 12 are press-fitted, are formed in the side wall 52, which is orthogonal to the width direction B from among the side walls of the second terminal housing 50. The locking tab receiving spaces 53, 53 are formed to extend through an outer surface to an inner surface of the side wall 52 in a rectangular shape when seen in planar view.

In an embodiment, holding recesses (non-penetrating) having divot-like shapes, are disposed on the inner surface toward the outer surface of the side wall 52 instead of the locking tab receiving spaces 53, 53, which penetrate through the outer surface to the inner surface of the side wall 52.

A second terminal receiving opening 55 (see FIG. 3), into which the second male type terminal is inserted, is formed in a second terminal housing base 54 of the second terminal housing 50.

The second terminal housing 50 is mechanically coupled to the second female terminal 12 with the holding protrusions 19*a*, 19*b* being press-fitted into the locking tab receiving spaces 53, 53. The second terminal housing 50 is not engaged with the other housing members, namely the first terminal housing 40, the shell 30 and the upper housing 60. Accordingly, upon input of vibration of an electronic device (not shown) to the second female terminal 12, which is connected and conducted with the second male type terminal 4 connected to the electronic device, the second terminal housing 50 and the second female terminal 12 vibrate integrally.

In an embodiment of FIG. 3, an upper housing 60 covers the receiving opening (not labeled) of the shell 30.

The upper housing 60 includes a top plate 61, and a pair of side walls 62A, 62B extending downward from the periphery of the top plate 61.

The side walls 62A, 62B are positioned inside of the receiving opening of the shell 30. The coupling spring 20 of the female type terminal 10 is positioned between the side walls 62A, 62B.

When inserted into the receiving opening of the shell 30, an inward facing end of the side wall 62A opposes the positioning protrusion 18 of the first female terminal 11 and sandwiches the positioning protrusion 18 between itself and an upper end of the side wall 45 of the first terminal housing 40. With this arrangement, the female type terminal 10 is engaged on the first female terminal 11 side.

A locking groove 65 is formed in the upper housing 60 to engage with a complementary locking protrusion 49 positioned on an outer surface of the first terminal housing 40 (see FIG. 2).

In a state in which the electrical connector 1 is assembled, the second terminal housing 50 is not engaged with the other housing elements, such as the shell 30, the first terminal housing 40 and the upper housing 60 as described above. Accordingly, the second terminal housing 50 with the second female terminal 12 vibrates independently from the other elements.

The second female terminal 12 and the second terminal housing 50 are displaceable independently from the first female terminal 11 by through the coupling spring 20 connected to the second female terminal 12.

An exemplary assembly of the electrical connector 1 will now be described.

First, In an embodiment of FIG. 6, the second terminal housing 50 is connected to the second female terminal 12 of the female type terminal 10. At this time, the second female terminal 12 is inserted into the terminal receiving space 51 of the second terminal housing 50, through the terminal receiving opening of the second terminal housing 50. The holding protrusions 19*a*, 19*b* of the second female terminal 12 are respectively press-fitted into the locking tab receiving spaces 53, 53 of the second terminal housing 50.

In an embodiment of FIG. 5, each of the locking tabs 191 of the holding protrusions 19*a*, 19*b* is press-fitted to anchor into the inner peripheral surface of the locking tab receiving spaces 53, such that the second female terminal 12 is firmly fixed to the second terminal housing 50.

Thereafter, the plurality of female type terminals 10, to each of which the second terminal housing 50 is attached, is positioned in the first terminal housing 40. In an embodiment of FIG. 3, the first female terminals 11 of the female type terminals 10 will thus be positioned in the first terminal receiving space 47 of the first terminal housing 40.

Next, the upper housing 60 is connected to the first terminal housing 40. Then, the positioning protrusions 18 of the first female terminals 11 of the female type terminals 10 are sandwiched and engaged between the first terminal housing 40 and the upper housing 60. The locking groove 65 of the upper housing 60 and the locking protrusion 49 of the first terminal housing 40 are engaged (FIG. 2).

The housing 5 comprising the first terminal housing 40, the second terminal housings 50 and the upper housing 60 is then mated with the shell 30. Consequently, the first housing base 41 of the first terminal housing 40, corresponding to the position at which the first female terminal 11 is positioned, is positioned adjacent at the shell base 31. The locking protrusion 46 of the first terminal housing 40 is engaged with the locking groove 37 of the shell 30. In this respect, a portion of the shell base 31 has been removed at a position corresponding to the second terminal housing base 54 of the second terminal housing 50.

In this manner, the electrical connector 1 is assembled.

In mating the female type terminals 10 of the electrical connector 1 with the first male type terminals 3 and the second male type terminals 4, the housings 5 are inserted into the shell 30 to which the first male type terminals 3 are attached. The second male type terminals 4 project through the terminal receiving grooves 8 of the circuit board 6, and are positioned through the second terminal receiving openings 55 of the second terminal housings 50.

At this time, the second terminal housings 50 are moved upward by being pushed up by the second male type terminals 4, until the upper ends of the side walls of the second terminal housings 50 abut against a lower end of the side wall 62B of the upper housing 60. Upward movement is therefore limited. It is accordingly possible to push the second male type terminals 4 into the second terminal housings 50 with no difficulty to make them contact and conduct with the second female terminals 12.

Actions and effects of the electrical connector 1 will be explained.

The female type terminals 10 of the electrical connector 1 are mated with both of the first male type terminals 3 provided on the circuit board 6 and the second male type terminals 4 provided on an electronic device different from the device provided with the circuit board 6. Vibrational forces are received through the first male type terminals 3 to the first female terminals 11, that may be different to those received through the second male type terminals 4 to the second female terminals 12 when the circuit board 6 and the other electronic device vibrate at different behaviors. At this time, a relative displacement between the first female terminals 11 and the second female terminals 12 is permitted through elastic deformation of the connecting beams 23 of the coupling springs 20.

Since the first male type terminals 3 and the first female terminals 11, as well as the second male type terminals 4 and the second female terminals 12, are respectively in contact and conduct with each other at a contact pressure which is larger than the force required for the coupling springs 20 to elastically deform, the first female terminals 11 side and the second female terminals 12 side can individually displace. However, even during such displacement, the connecting positions between the first female terminals 11 and the first male type terminals 3 as well as the second female terminals 12 and the second male type terminals 4, are maintained.

Accordingly, both of the first female terminals 11 and the first male type terminals 3, as well as the second female terminals 12 and the second male type terminals 4, can vibrate in sync with vibrations of the circuit board 6 and the other electronic device respectively while maintaining their connecting positions.

Further, since relative displacement of both of the first female terminals 11 side and the second female terminals 12 side is permitted, it is possible to avoid scraping of the first female terminals 11 and the second female terminals 12, the terminal housing 5, and the first male type terminals 3 and the second male type terminals 4 with respect to each other or application of excess force thereto. Accordingly, it is possible to prevent wear or damage of these members.

The electrical connector 1 positions the second female terminals 12 of the female type terminals 10 through the second terminal housings 50, which are not in a mechanically coupled relationship with the first terminal housing 40. By press-fitting the holding protrusions 19*a*, 19*b* of the second female terminals 12 into the locking tab receiving spaces 53, 53 of the second terminal housings 50, the second female terminals 12 are fixed to the second terminal housings 50.

Accordingly, when the second female terminals 12 vibrate in sync with the vibration of the electronic device, the second terminal housings 50 also vibrate integrally with the second female terminals 12. The second female terminals 12, the second male type terminals 4 transmitting vibration to the second female terminals 12, and the second terminal housings 50 which hold the second female terminals 12 with the locking tab receiving spaces 53, 53 and which receive the second male type terminals 4 in the second terminal receiving openings 55, will vibrate integrally as a unit.

Conventionally, when the second female terminals 12 and the first female terminals 11 are held by the same housing, the second female terminals 12 and the second male type terminals 4 vibrate in sync with the vibration of the electronic device, the housing holding the second female terminals 12 will be affected by the vibration of the first female terminals 11 side so that they will behave differently from the second female terminals 12 and the second male type terminals 4. Consequently, the second male type terminals 4 and the housing holding outer peripheries thereof might scrape with each other so that there is a risk of wear.

In contract to the conventional design, the second terminal housings 50 holding the second female terminals 12 are positioned separate from the first terminal housing 40 holding the first female terminals 11. By integrally vibrating three of the second female terminals 12, the second male type terminals 4 and the second terminal housings 50, the problem of wear between the second male type terminals 4 and the housings is solved. With this arrangement, the problem of peeling of the plating film formed on the surface of the second male type terminals 4 is prevented, so that it is possible to block short-circuiting of peripheral electronic circuits.

In addition to the above, effects which can be obtained by press-fitting the holding protrusions 19*a*, 19*b* of the second female terminals 12 into the locking tab receiving spaces 53, 53 of the second terminal housings 50 will be explained.

Conventionally, when fixing a female terminal to a housing, an engaging beam (lance) is typically formed on either one of the female terminal or the housing while the other is formed with a receiving portion for receiving the engaging beam. The engaging beam extends along the inserting and extracting directions of the terminal, overrides the receiving portion when the female terminal is assembled to the housing and is engaged with the receiving portion. The female terminal is held at the housing through elastic force of the engaging beam.

In contrast to the conventional design, the electrical connector 1 eliminates the above-described engaging beam and receiving portion, instead, the holding protrusions 19*a*, 19*b* and the locking tab receiving spaces 53, 53, which are of simpler configuration, are formed for holding the female type terminal 10 at the terminal housing 5.

The conventional engaging beam is often formed by stamping a metallic plate and by subsequently bending the stamped spot into a predetermined shape. Therefore, with the conventional engaging beam, it is further necessary to suitably perform additional processing so as to exhibit predetermined elastic force.

In contrast thereto, the holding protrusions 19*a*, 19*b* can be formed by merely stamping a metallic plate, and it does not require bending processes for forming the same. It is further unnecessary to process the holding protrusions 19*a*, 19*b* with strict accuracies as long as they can be press-fitted into the locking tab receiving spaces 53, 53.

Additionally, the locking tab receiving spaces 53, 53 by be simple through holes without grooves or the like being formed on the inner peripheral surfaces, and they can be formed upon injection molding the second terminal housing.

Therefore, both of the holding protrusions 19*a*, 19*b* and the locking tab receiving spaces 53, 53 can be easily formed as simple forms through simple processing and forming.

In addition to advantages in production which can be obtained thereby, with the second female terminal 12 being held by the second terminal housing 50 by press-fitting the holding protrusions 19*a*, 19*b* into the locking tab receiving spaces 53, 53, it can be held more reliably when compared to a case employing the conventional engaging beam. In an embodiment of FIG. 7, the holding protrusions 19*a*, 19*b* project in the width direction B, orthogonal to the inserting and extracting directions A, and the locking tab receiving spaces 53, 53 are formed along the width direction B. Accordingly, when the holding protrusions 19*a*, 19*b* are press-fitted into the locking tab receiving spaces 53, 53, the coupling between the second female terminal 12 and the second terminal housing 50 is maintained, even upon application of large external force in the inserting and extracting directions A, unless the holding protrusions 19*a*, 19*b* are broken. In contrast thereto, in case of the conventional engaging beam, there is a risk that the female terminal is detached from the housing in the inserting and extracting directions upon action of external force in the inserting and extracting directions exceeding the elastic force by the engaging beam. While increasing the thickness or the length of the engaging beam might be helpful for avoiding such instances, the space necessary for the engaging beam to deflect would be increased, which, in turn, would be lead to increases in size of the connector.

By press-fitting the holding protrusions 19*a*, 19*b* into the locking tab receiving spaces 53, 53, the coupling is maintained unless the holding protrusions 19*a*,19*b* are broken.

Further, the holding protrusions 19*a*, 19*b* are small protrusions projecting a distance with which they do not reach the outer peripheral surface of the side wall 52 of the second terminal housing 50 when press-fitted into the locking tab receiving spaces 53, 53 on one end of the terminal body 13 of the second female terminal 12 (see FIG. 5). The holding protrusions 19*a*, 19*b* have a cross-sectional area (by lateral width and plate thickness) large enough to withhold breakage with respect to external force which might be applied.

Further still, since the holding protrusions 19*a*, 19*b* are surrounded by the inner peripheral surfaces of the locking tab receiving spaces 53, 53, the holding force is exhibited also with respect to external force acting in direction C orthogonal to both of the inserting and extracting directions A and the width direction B (direction orthogonal to the paper surface in FIG. 7), or an external force acting in a direction which intersects a surface orthogonal to the width direction B (surface of the side wall 52 of the second terminal housing 50). Here, when the connecting portions 192, which are narrower than the locking tabs 191 of the holding protrusions 19*a*, 19*b*, are elastically deformed through external force, no excess stress will act on the holding protrusions 19*a*, 19*b* so that it is possible to avoid breakage.

According to the above, it is possible to ensure a firm holding force while avoiding increases in size of the electrical connector 1 by employing the holding protrusions 19*a*, 19*b* and the locking tab receiving spaces 53, 53.

Moreover, it is possible to realize simplification of configuration and facilitation of processing and forming when compared using the conventional engaging beam and the receiving portion, manufacturing costs may be reduced.

In an embodiment, since two each of the holding protrusions 19*a*, 19*b* and the locking tab receiving spaces 53, 53 are disposed in a staggered manner, it is possible to hold the second female terminal 12 by the second terminal housing 50 in a more firmly manner with respect to the above-mentioned shift direction.

More specifically (see FIG. 6), the holding protrusions 19*a*, 19*b* are disposed to be parallel in the direction C (plate thickness direction) and to be shifted in the inserting and extracting directions A. When they are held at these positions, displacement through moment around an axis which is a direction connecting the holding protrusions 19*a*, 19*b* will be restricted also upon application of external force in rotating directions (all of which are shift directions) of each of the inserting and extracting directions A, the width direction B and the direction C so that the second female terminal 12 is held in a more reliable manner.

While the present invention has been explained in terms of exemplary embodiments thereof, the present invention is not limited to these embodiments.

The configuration of the present invention in which the holding protrusions of the female terminal are press-fitted into a part of the housing can be applied not only to the female type terminal 10 including two female terminals 11, 12, but also to a single female terminal.

While the holding protrusions 19*a*, 19*b* may alternately positioned along the inserting and extracting directions A, the present invention also includes embodiments in which positions of the holding protrusions 19*a*, 19*b* in the inserting and extracting directions A are aligned to be the same. The present invention includes embodiments in which the two holding protrusions are formed upon being aligned on the same straight line along the inserting and extracting directions A.

In an embodiment, three holding protrusions which are not aligned on the same straight line may also be used. For example, a third holding protrusion may be added on either one side of the holding protrusions 19*a*, 19*b*. Since a plane is uniquely defined by the three holding protrusions, it is possible to more reliably restrict displacement in a direction orthogonal to the plane.

While an example in which separate second terminal housings 50 corresponding to the second female terminals 12 has been illustrated in the above embodiments, it is also possible to integrally form the plurality of second terminal housings 50.

The form of the coupling spring 20 is only one exemplary embodiment, and it is also possible to employ other shapes and dimensions as long as the above-described effects can be obtained. For example, the connecting beam 23 might also be straight or Z-shaped, instead of S-shaped.

While the first female terminals 11 and the second female terminals 12 are manufactured to be of substantially identical specifications in the above embodiments, the present invention allows the use of two female terminals of different specifications. Further, while the male type terminals are inserted into the first female terminals 11 and the second female terminals 12 respectively from the same direction, and the terminals 11, 12 are disposed in parallel, this is also just one example, and there are no restrictions for disposing the two female terminals and of directions from which the male type terminals are inserted in the present invention.

Moreover, while examples of box-type female type terminals and tab-type male type terminals have been illustrated in the present embodiment, it is also possible to apply the present invention to female type terminals and male type terminals of different types.

Further, the configuration of the housings 5 is also not limited to that of the above-described embodiment. For instance, it is also possible to integrally form the first terminal housing 40 and the shell 30.

In addition to the above, the configurations listed in the above embodiment can be variously chosen or suitably changed to other configurations as long as such variations do not depart from the gist of the present invention.

What is claimed is:

1. An electrical connector, comprising:

a terminal housing;

a female terminal positioned in the terminal housing and having a terminal body into which a complementary male terminal may be inserted and extracted; and a holding protrusion comprising two or more holding protrusions projecting from the terminal body in a direction orthogonal to inserting and extracting directions, being formed to be substantially tabular in shape along the inserting and extracting directions, and being press-fitted in a complementary locking tab receiving space extending through a sidewall of the terminal housing in the direction orthogonal to the inserting and extracting directions.

2. The electrical connector according to claim 1, wherein the terminal housing includes a terminal receiving opening positioned on an end, in the direction orthogonal to the inserting and extracting directions.

3. The electrical connector according to claim 2, wherein the female terminal is positioned in the terminal housing through the terminal receiving opening.

4. The electrical connector according to claim 1, wherein the terminal housing includes a plurality of sidewalls having an inward facing surface and an outward facing surface.

5. The electrical connector according to claim 1, wherein the holding protrusions are positioned a distance apart along the inserting and extracting directions.

6. The electrical connector according to claim 5, wherein the holding protrusions are positioned in a same plane.

7. The electrical connector according to claim 5, wherein the holding protrusions are positioned in different planes along the inserting and extracting directions.

8. The electrical connector according to claim 5, wherein the holding protrusions are positioned a second distance apart in a direction perpendicular to the inserting and extracting directions.

9. The electrical connector according claim 1, wherein the holding protrusion includes a locking tab which is press-fitted into the terminal housing.

10. The electrical connector according to claim 9, wherein the locking tab is formed with beveled edges on both sides thereof, such that a width along the inserting and extracting directions becomes gradually narrower on a tip end.

11. The electrical connector according to claim 9, wherein the holding protrusion further includes a connecting portion connected on a first end to the terminal body.

12. The electrical connector according to claim 11, wherein the connecting portion is connected to the locking tab on an opposite second end.

13. The electrical connector according to claim 11, wherein the connecting portion has a width that is less than a width of the locking tab along the inserting and extracting directions.

* * * * *